US012606751B2

(12) United States Patent
Guida et al.

(10) Patent No.: US 12,606,751 B2
(45) Date of Patent: Apr. 21, 2026

(54) METHOD FOR HEAVY FUEL DESULFURIZATION USING ULTRASONICALLY INDUCED CAVITATION

(71) Applicant: KING ABDULLAH UNIVERSITY OF SCIENCE AND TECHNOLOGY, Thuwal (SA)

(72) Inventors: Paolo Guida, Thuwal (SA); William LaFayette Roberts, IV, Thuwal (SA); Saumitra Saxena, Thuwal (SA)

(73) Assignee: KING ABDULLAH UNIVERSITY OF SCIENCE AND TECHNOLOGY, Thuwal (SA)

( * ) Notice: Subject to any disclaimer, the term of this patent is extended or adjusted under 35 U.S.C. 154(b) by 236 days.

(21) Appl. No.: 18/558,937

(22) PCT Filed: May 5, 2022

(86) PCT No.: PCT/IB2022/054149
§ 371 (c)(1),
(2) Date: Nov. 3, 2023

(87) PCT Pub. No.: WO2022/234501
PCT Pub. Date: Nov. 10, 2022

(65) Prior Publication Data

US 2025/0320415 A1 Oct. 16, 2025

Related U.S. Application Data

(60) Provisional application No. 63/184,865, filed on May 6, 2021, provisional application No. 63/184,877, filed on May 6, 2021.

(51) Int. Cl.
*C10G 27/12* (2006.01)

(52) U.S. Cl.
CPC ..... *C10G 27/12* (2013.01); *C10G 2300/1033* (2013.01); *C10G 2300/1044* (2013.01);
(Continued)

(58) Field of Classification Search
CPC ..... C10G 27/12; C10G 2300/1033; C10G 2300/1044; C10G 2300/1077; C10G 2300/207; C10G 2300/40
See application file for complete search history.

(56) References Cited

U.S. PATENT DOCUMENTS 6,402,939 B1 6/2002 Yen et al.
6,500,219 B1 12/2002 Gunnerman
(Continued)

FOREIGN PATENT DOCUMENTS

WO 200226916 A1 4/2002

OTHER PUBLICATIONS

The cavitation erosion of ultrasonic sonotrode during large-scale metallic casting: Experiment and simulation , Ultrasonics—Sonochemistry 43, 29-37 (Year: 2018).*
(Continued)

*Primary Examiner* — Randy Boyer
*Assistant Examiner* — Juan C Valencia
(74) *Attorney, Agent, or Firm* — Tucker Ellis LLP

(57) ABSTRACT

A process is disclosed for removing sulfides from liquid fossil fuel comprising mixing the liquid fossil fuel with an oxidizer and catalyst to form a multiphase reaction medium and producing a fluid flow of the multiphase reaction medium. Ultra sound may be applied to the multiphase reaction medium to cause oxidation of sulfides in the liquid fossil fuel to sulfones; and extracting the sulfones to yield an organic phase and aqueous phase. The ultra sound is performed by generating vibrations parallel to the fluid flow of
(Continued)

the multiphase reaction medium. The organic phase substantially consists of desulfurized fuel.

20 Claims, 8 Drawing Sheets

(52) U.S. Cl.
CPC ..... *C10G 2300/1077* (2013.01); *C10G 2300/207* (2013.01); *C10G 2300/40* (2013.01)

(56) References Cited

U.S. PATENT DOCUMENTS

| | | | |
|---|---|---|---|
| 7,374,666 | B2 | 5/2008 | Wachs |
| 7,666,297 | B2 | 2/2010 | Lee et al. |
| 8,197,763 | B2 | 6/2012 | Yen et al. |
| 2007/0051667 | A1 | 3/2007 | Martinie et al. |
| 2008/0173571 | A1* | 7/2008 | Yen ..... C10G 25/05 208/213 |
| 2008/0308463 | A1 | 12/2008 | Kecker et al. |
| 2021/0002562 | A1 | 1/2021 | Almao et al. |

OTHER PUBLICATIONS

International Searching Report for corresponding PCT application No. PCT/IB2022/054149, international filing date May 5, 2022, 4 pages.
Written Opinion of the International Searching Authority for corresponding PCT application No. PCT/IB2022/054149, international filing date May 5, 2022, 6 pages.
Herandez Ponce, Claudia, "Modeling of Sulfur Removal from Heavy Fuel Oil Using Ultrasound-Assisted Oxidative Desulfurization," King Abdullah University of Science and Technology, Thuwal, Jun. 2020, pp. 1-65, Kingdom of Saudi Arabia.
King Abdullah Unversity of Science and Technology, "Saudi Arabia Substantive Examination Report," from related Saudi patent application No. 523451416, dated Aug. 15, 2024, 7 pages.

* cited by examiner

METHOD FOR HEAVY FUEL DESULFURIZATION USING ULTRASONICALLY INDUCED CAVITATION

CROSS-REFERENCE TO RELATED APPLICATIONS

This application is a national phase application of International Application No. PCT/IB2022/054149, filed May 5, 2022, which claims priority to U.S. Patent Application Ser. No. 63/184,865, filed May 6, 2021, and claims priority to U.S. Patent Application Ser. No. 63/184,877, filed May 6, 2021, all of which are incorporated herein by reference.

BACKGROUND

The present disclosure relates the field of the desulfurization of petroleum and petroleum-based fuels.

While alternative sources of power are under development and in use in many parts of the world, fossil fuels remain the largest and most widely used source due to their high efficiency, proven performance, and relatively low prices. Fossil fuels take many forms, ranging from petroleum fractions to coal, tar sands, and shale oil, and their uses extend from consumer uses such as automotive engines and home heating to commercial uses such as boilers, furnaces, smelting units, and power plants.

A persistent problem in the processing and use of fossil fuels is the presence of sulfur, notably in the form of organic sulfur compounds. Sulfur has been implicated in the corrosion of pipeline, pumping, and refining equipment and in the premature failure of combustion engines. Sulfur is also responsible for the poisoning of catalysts used in the refining and combustion of fossil fuels. By poisoning the catalytic converters in automotive engines, sulfur is responsible in part for the emissions of oxides of nitrogen (NOx) from diesel-powered trucks and buses. Sulfur is also responsible for the particulate (soot) emissions from trucks and buses since the traps used on these vehicles for controlling these emissions are quickly degraded by high-sulfur fuels. Perhaps the most notorious characteristic of sulfur compounds in fossil fuels is the conversion of the sulfur in these compounds to sulfur dioxide when the fuels are combusted. The release of sulfur dioxide to the atmosphere results in acid rain, a deposition of acid that is harmful to agriculture, wildlife, and human health. Ecosystems of various kinds are threatened with irreversible damage, as is the quality of life.

Thus, the need for more effective desulfurization methods is always present. In addition to the difficulty in lowering sulfur emissions to meet the requirements, the petroleum industry also faces the increased production costs associated with sophisticated desulfurization methods and the unfavorable reactions of consumers and governments to increased prices. The costs associated with fossil fuels are some of the major factors affecting the world economy.

SUMMARY

According to first broad aspect, the present disclosure provides a process for removing sulfides from liquid fossil fuel comprising: mixing the liquid fossil fuel with an oxidizer and catalyst to form a multiphase reaction medium and producing a fluid flow of the multiphase reaction medium; applying ultra sound to the multiphase reaction medium to cause oxidation of sulfides in the liquid fossil fuel to sulfones; and extracting the sulfones to yield an organic phase and aqueous phase. The ultra sound is performed by generating vibrations parallel to the fluid flow of the multiphase reaction medium. The organic phase substantially consists of desulfurized fuel.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the invention.

DETAILED DESCRIPTION OF THE INVENTION

Figure 1:
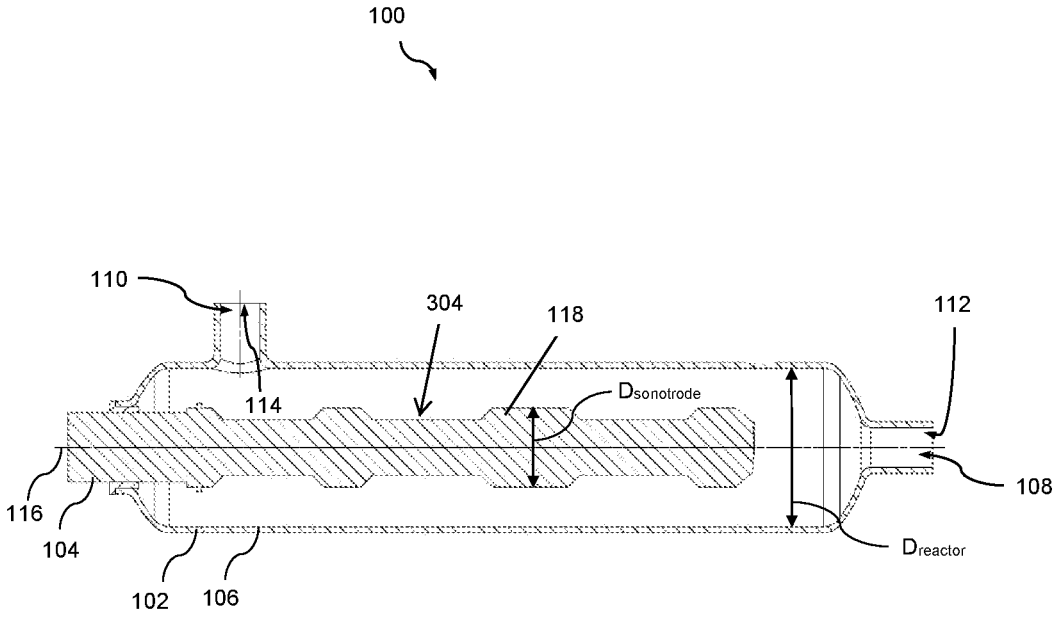
FIG. 1 is an illustration of an exemplary ultrasonically induced cavitation (UIC) reactor according to one embodiment of the present disclosure.

Where the definition of terms departs from the commonly used meaning of the term, applicant intends to utilize the definitions provided below, unless specifically indicated.

It is to be understood that the foregoing general description and the following detailed description are exemplary and explanatory only and are not restrictive of any subject matter claimed. In this application, the use of the singular includes the plural unless specifically stated otherwise. It must be noted that, as used in the specification and the appended claims, the singular forms "a," "an" and "the" include plural referents unless the context clearly dictates otherwise. In this application, the use of "or" means "and/or" unless stated otherwise. Furthermore, use of the term "including" as well as other forms, such as "include", "includes," and "included," is not limiting.

For purposes of the present disclosure, the term "comprising", the term "having", the term "including," and variations of these words are intended to be open-ended and mean that there may be additional elements other than the listed elements.

For purposes of the present disclosure, directional terms such as "top," "bottom," "upper," "lower," "above," "below," "left," "right," "horizontal," "vertical," "up," "down," etc., are used merely for convenience in describing the various embodiments of the present disclosure. The embodiments of the present disclosure may be oriented in various ways. For example, the diagrams, apparatuses, etc., shown in the drawing figures may be flipped over, rotated by 90° in any direction, reversed, etc.

For purposes of the present disclosure, a value or property is "based" on a particular value, property, the satisfaction of a condition, or other factor, if that value is derived by performing a mathematical calculation or logical decision using that value, property or other factor.

For purposes of the present disclosure, it should be noted that to provide a more concise description, some of the quantitative expressions given herein are not qualified with the term "about." It is understood that whether the term "about" is used explicitly or not, every quantity given herein is meant to refer to the actual given value, and it is also meant to refer to the approximation to such given value that would reasonably be inferred based on the ordinary skill in the art, including approximations due to the experimental and/or measurement conditions for such given value.

For purposes of the present disclosure, the term "Arabian Extra Light (AXL)" refers to a medium-gravity, high-sulfur crude oil.

For purposes of the present disclosure, the term "centrifuge" refers to a device that uses centrifugal force to separate various components of a fluid. This may be achieved by spinning the fluid at high speed within a container, thereby separating fluids of different densities or liquids from solids. It works by causing denser substances and particles to move outward in the radial direction. At the same time, objects that are less dense are displaced and move to the center. In a laboratory centrifuge that uses sample tubes, the radial acceleration causes denser particles to settle to the bottom of the tube, while low-density substances rise to the top. A centrifuge can be a very effective filter that separates contaminants from the main body of fluid. Industrial scale centrifuges are commonly used in manufacturing and waste processing to sediment suspended solids, or to separate immiscible liquids.

For purposes of the present disclosure, the term "cavitation" refers to a phenomenon in which the static pressure of a liquid reduces to below the liquid's vapor pressure, leading to the formation of small vapor-filled cavities in the liquid. When subjected to higher pressure, these cavities, called "bubbles" or "voids," collapse and can generate shock waves that may damage machinery. These shock waves are strong when they are very close to the imploded bubble, but rapidly weaken as they propagate away from the implosion. Cavitations consists in the formation of vapor cavities within a liquid continuum because of pressure gradients.

For purposes of the present disclosure, the term "cavitation zones," "cavitating zones," and/or "reaction zones," refers to zones in which cavitation takes place.

For purposes of the present disclosure, the term "feedstock" refers to any petroleum derivate that can be modified by the disclosed oxidative desulfurization (ODS) process.

For purposes of the present disclosure, the term "heavy fuel oil" (HFO) refers to a category of fuel oils of a tar-like consistency. Also known as bunker fuel, or residual fuel oil, HFO is the result or remnant from the distillation and cracking process of petroleum. For this reason, HFO is contaminated with several different compounds including aromatics, sulfur and nitrogen, making emission upon combustion more polluting compared to other fuel oils. HFO may consist of the remnants or residual of petroleum sources once the hydrocarbons of higher quality are extracted via processes such as thermal and catalytic cracking. Thus, HFO is also commonly referred to as residual fuel oil. The chemical composition of HFO is highly variable due to the fact that HFO is often mixed or blended with cleaner fuels, blending streams can include carbon numbers from $C_{20}$ to greater than $C_{50}$. HFOs are blended to achieve certain viscosity and flow characteristics for a given use. As a result of the wide compositional spectrum, HFO is defined by processing, physical and final use characteristics. Being the final remnant of the cracking process, HFO also contains mixtures of the following compounds to various degrees: "paraffins, cycloparaffins, aromatics, olefins, and asphaltenes as well as molecules containing sulfur, oxygen, nitrogen and/or organometals." HFO may be characterized by a maximum density of 1010 kg/m3 at 15° C., and a maximum viscosity of 700 mm2/s (cSt) at 50° C. according to ISO 8217.

For purposes of the present disclosure, the term "hotspot" refers generally to a finite location within a mixture which may be regarded at an extremely high temperature for a given period of time. In some embodiments, hotspots are finite zones in the reactor that are generally formed as a consequence of bubbles' collapse which present extremely high temperature and pressure.

For purposes of the present disclosure, the term "hydrocarbon" refers to an organic compound consisting entirely of hydrogen and carbon. Hydrocarbons are examples of group 14 hydrides. Hydrocarbons are generally colorless and hydrophobic with only weak odors. In the oil & gas industry, hydrocarbon is a generalized term, which combines petroleum and natural gas as the two naturally occurring phases of hydrocarbon commoditized by the sector. Most anthropogenic emissions of greenhouse gases are from the burning of fossil fuels including fuel production and combustion. Natural sources of hydrocarbons such as ethylene, isoprene, and monoterpenes come from the emissions of vegetation. Hydrocarbons can be gases (e.g., methane and propane), liquids (e.g., hexane and benzene), waxes or low melting solids (e.g., paraffin wax and naphthalene) or polymers (e.g., polyethylene, polypropylene and polystyrene).

For purposes of the present disclosure, the term "hydrodesulfurization" refers to a catalytic chemical process widely used to remove sulfur(S) from natural gas and from refined petroleum products, such as gasoline or petrol, jet fuel, kerosene, diesel fuel, and fuel oils. The purpose of removing the sulfur, and creating products such as ultra-low-sulfur diesel, is to reduce the sulfur dioxide (SO2) emissions that result from using those fuels in automotive vehicles, aircraft, railroad locomotives, ships, gas or oil burning power plants, residential and industrial furnaces, and other forms of fuel combustion.

For purposes of the present disclosure, the term "oxidizer" refers to a species that accepts an electron in a redox reaction.

For purposes of the present disclosure, the term "room temperature" refers to a temperature of from about 20° C. to about 25° C.

For purposes of the present disclosure, the term "sonotrode" refers to a tool that creates ultrasonic vibrations and applies this vibrational energy to a gas, liquid, solid or tissue. A sonotrode may consists of a stack of piezoelectric transducers attached to a probe such as a metal rod. The end of the rod is applied to the working material. In some embodiments, an alternating current oscillating at ultrasonic frequency is applied by a separate power supply unit to the piezoelectric transducers. The current causes them to expand and contract. The frequency of the current is chosen to be the resonant frequency of the tool, so the entire sonotrode acts as a half-wavelength resonator, vibrating lengthwise with standing waves at its resonant frequency. In some configurations, the standard frequencies used with the disclosed ultrasonic sonotrode may range from 20 kHz to 70 kHz. The disclosed amplitude of the vibration may be small, about 13 to 130 micrometres. In some embodiments, the disclosed sonotrode may be made of titanium, aluminium or steel, with or without heat treatment (carbide). The geometrical shape of the sonotrode (e.g., round, square, toothed, profiled, etc.) may depend on the quantity of vibratory energy and a physical constraint for a specific application wherein its shape is optimized for particular applications. In some embodiments, the disclosed sonotrode may be referred to as a probe.

For purposes of the present disclosure, the term "sonochemistry" refers to the use of ultrasound to enhance or alter chemical reactions. Sonochemistry may occur when ultrasound induces "true" chemical effects on the reaction system, such as forming free radicals which accelerate the reaction. However, ultrasound may have other mechanical effects on the reaction, such as increasing the surface area between the reactants, accelerating dissolution, and/or renewing the surface of a solid reactant or catalyst.

For purposes of the present disclosure, the term "sulfide" refers to an inorganic anion of sulfur with the chemical formula $S^{2-}$ or a compound containing one or more $S^{2-}$ ions. Solutions of sulfide salts are corrosive. Sulfide may also refer to chemical compounds of large families of inorganic and organic compounds, e.g., lead sulfide and dimethyl sulfide. Hydrogen sulfide ($H_2S$) and bisulfide (SH—) are the conjugate acids of sulfide.

For purposes of the present disclosure, the term "sulfone" refers to a chemical compound containing a sulfonyl functional group attached to two carbon atoms. The central hexavalent sulfur atom is double-bonded to each of two oxygen atoms and has a single bond to each of two carbon atoms, usually in two separate hydrocarbon substituents.

For purposes of the present disclosure, the term "thiophene" refers to a class of hydrocarbons which presents sulfur as heteroatoms within an aromatic ring.

While the invention is susceptible to various modifications and alternative forms, specific embodiment thereof has been shown by way of example in the drawings and will be described in detail below. It should be understood, however that it is not intended to limit the invention to the particular forms disclosed, but on the contrary, the invention is to cover all modifications, equivalents, and alternatives falling within the spirit and the scope of the invention.

In accordance with disclosed embodiments, oxidative desulfurization (ODS) is a process that facilitates the removal of thiophenes (most effective) and sulfides (less effective) from light and heavy petroleum fractions. This process may be less common than hydrodesulfurization (HDS), which may be employed globally for desulfurizing lighter distillates such as diesel and jet fuels. The disclosed ODS process consists of mixing an oxidizing agent with the hydrocarbon mixture, often using an acidic medium as a catalyst. The oxidizing agent reacts with the sulfur, transforming the thiophene or sulfide into a sulfone. The process proceeds by mixing the processed mixture with an extractant. The extractants, commonly acetonitrile or methanol, preferentially remove the sulfones because of their higher polarity.

Despite the capability of attacking a wide range of sulfur molecules, ODS works preferentially with thiophenes. Disclosed embodiments employ the ODS to every petroleum or petroleum fraction and in particular heavy fuels, which generally present a high thiophene content, which is a necessary condition to make the disclosed invention a commercially valuable process.

Varieties of challenges, however, have affected the performance of previous processes, therefore, precluding commercialization. Such challenges may include, for example, (1) low yield, (2) difficulty in separating produced sulfones, (3) expensive reactants and (4) dramatic changes in fuel viscosity due to the formation of polymers. Low yield implies that most of the sulfur stays in the fuel, and it is therefore not compliant with regulations. Expensive reactants imply that the product becomes expensive. High viscosity creates problem when moving the fuel as it requires increased pumps size and power.

Some attempts within the prior art have been made perform desulfurization processes. For example, U.S. Pat. No. 6,402,939 B1 issued to Yen, et al. is directed to the use of fossil fuels combined with a hydroperoxide in an aqueous-organic medium and subjected to ultrasound, with the effect of oxidizing the sulfur compounds in the fuels to sulfones. However, Yen, et al. does not contemplate the use a liquid catalyst such as acetic acid. Whereas disclosed embodiments utilize a catalyst to achieve good conversion. Furthermore, the reactor of the disclosed invention is provided with a particular configuration conducive to achieving optimal success as opposed to the generic "ultrasound source" of Yen, et al.

U.S. Pat. No. 7,374,666 B2 issued to Wachs is directed to oxidative desulfurization of sulfur-containing hydrocarbons. Wachs discloses a method for desulfurizing a hydrocarbon stream containing heterocyclic sulfur compounds, which process comprises contacting the heterocyclic sulfur compounds in the gas phase in the presence of oxygen with a supported metal oxide catalyst, or with a bulk metal oxide catalyst to convert at least a portion of the heterocyclic sulfur compounds to oxygenated products as well as sulfur-deficient hydrocarbons and separately recovering the oxygenated products separately from a hydrocarbon stream with substantially reduced sulfur. Wachs is concerned with a process to convert gaseous hydrocarbons. Conversely, the disclosed invention proposes a process that aims to desulfurize liquid fuels.

U.S. Pat. No. 7,666,297 B2 issued to Lee, et al. is directed to oxidative desulfurization and denitrogenation of petroleum oils. Lee, et al. disclose an improved oxidative process that employ a robust, non-aqueous, and oil-soluble organic peroxide oxidant for effective desulfurization and denitrogenation of hydrocarbons including petroleum fuels, hydrotreated vacuum gas oil (VGO), non-hydrotreated VGO, petroleum crude oil, synthetic crude oil from oil sand, and residual oil. Lee, et al. is concerned with a process to convert gaseous hydrocarbons. Conversely, the disclosed invention proposes a process that aims to desulfurize liquid fuels.

U.S. Pat. No. 6,500,219 B1 issued to Gunnerman is directed to a continuous process for oxidative desulfurization of fossil fuels with ultrasound and products thereof. Gunnerman discloses fossil fuels that are combined with a hydroperoxide, a surface active agent, and an aqueous liquid to form an aqueous-organic reaction medium which is passed through an ultrasound chamber on a continuous flow-through basis. The emerging mixture separates spontaneously into aqueous and organic phases, from which the organic phase is readily isolated as the desulfurized fossil fuel. The invention of Gunnerman is directed to a process to convert diesel fuel spec in the $C_5$-$C_{20}$ range. In contrast, the disclosed process seeks to convert heavier cuts, with the peculiarity of a high thiophenes content.

U.S. Pat. No. 8,197,763 B2 issued to Yen, et al. is directed to an ultrasound-assisted oxidative desulfurization of diesel fuel using quaternary ammonium fluoride and portable unit for ultrasound-assisted oxidative desulfurization. The desulfurization of fossil fuels is effected by the combination of fossil fuels with an aqueous mixture of hydroperoxide and quaternary ammonium fluoride phase transfer catalyst. The mixture is then subjected to ultrasound to oxidize sulfur compounds present in the fuels. However, Yen, et al. does not provide any use of liquid catalyst such as acetic acid as proposed by the present disclosure. Conversely, described embodiments of the present disclosure utilize acetic acid necessary to achieve good conversion. In addition, Yen, et al. refers to the reactor configuration as a conical shape, whereas the configuration employed by the disclosed design includes a geometrical configuration having multiple cavitating zones in parallel.

U.S. Patent Application No. 2008/0308463 issued to Keckler, et al. is directed to an oxidative desulfurization process which reduces the sulfur and/or nitrogen content of a distillate feedstock to produce a refinery transportation fuel or blending components for refinery transportation fuel, by contacting the feedstock with an oxygen-containing gas in an 5 oxidation/adsorption zone at oxidation conditions in the presence of an oxidation catalyst comprising a titanium-containing composition whereby the sulfur species are converted to sulfones and/or sulfoxides which are adsorbed onto the titanium-containing composition. However, in contrast to the present disclosure, Keckler et al. does not utilize ultrasound to improve reactivity.

The present disclosure is directed towards overcoming one or more of the shortcomings set forth above. Disclosed embodiments propose a new process and a novel reactor design, which addresses the aforementioned problems with a combination of innovative solutions. The disclosed process employs ultrasonically-induced cavitation (UIC) to improve performance. In accordance with disclosed embodiments, UIC consists of using a vibrating sonotrode to induce pressure waves which eventually lead the formation of small bubbles (nano-scale) in the liquid which nucleate, oscillate and collapse within a short time scale compared to the flow field. In some disclosed embodiments, the aforementioned small bubbles may also be regarded as micro bubbles (i.e., bubbles having a diameter in the micron range).

Employing the disclosed UIC process and design provides several advantages: (1) The surface area between droplets of the oxidizer and the continuous phase made of oil increases because of improved mixing. Mixing may be achieved by using a vibrating probe (such as a sonotrode) within a vessel container as described more fully below. Improved mixing may be demonstrated by the fact that emulsions produced by ultrasonically induced cavitation are generally much smaller (e.g., two orders of magnitude) compared to emulsions formed through mechanical mixing with a similar power input per volume. (2) In addition, the formation of bubbles induces a second reactivity pathway as gas-liquid reactions. In disclosed embodiments, gas-liquid reaction rates are generally proportional to the surface area available between the liquid and the gas. Thus, reactivity is favored if the size of bubbles is very small as the ratio between surface and volume increases. (3) Bubbles' collapse induces the formation of jets in the liquid. The jets break apart the asphaltene aggregates, increasing the probability of exposing the sulfur atoms to the oxidizing agent. The scope of the disclosed ODS reaction is to selectively oxidize sulfur. Disclosed embodiment provide increased opportunity to put a sulfur atom in contact with oxygen therefore providing higher probability to achieve oxidation. (4) The smaller size of de-aggregated asphaltenes results in better atomization when forming emulsions as they act as a surfactant. Conventional techniques do not involve using ultrasounds as utilized in the present disclosure. Therefore, the mixture of conventional techniques presents smaller area between the oxidizing agent (oxidizer) and the oil matrix (sulfur containing oil) in contrast to disclosed embodiments. (5) The collapse of a bubble induces a hotspot, which leads to the radical formation (sonochemistry). Radicals formation consists into the creation of unstable molecules by breaking chemical bonds between atoms. As an example, the hydrogen peroxide releases on oxygen atom and becomes water. The oxygen atoms eventually reacts with sulfur forming a sulfone. The disclosed radicals may enhance the reaction rate, meaning that the disclosed reaction may take place faster (such as within the disclosed reactor, discussed below), thus reducing the time the fuel spends inside the reactor and the eventuality of secondary reactions take place (which may be slower in this case).

Disclosed embodiments may comprise a reactor that adopts ultrasonically induced cavitation (UIC) to enhance chemical reactivity while controlling the residence time of the fluid. FIG. 1 illustrates an embodiment of the disclosed UIC reactor configuration 100 for receiving a processing liquid such as specified fuels and/or fuel mixes. In some embodiments, exemplary fuel mixes may include liquid fossil fuel with an oxidizer such as hydrogen peroxide ($H_2O_2$) and an acidic medium as a catalyst, such as acetic acid, to form a multiphase reaction medium. The acidic medium enhances the chemical reactivity of the disclosed system.

Embodiments of the disclosed reactor provide that the disclosed ultrasound reactor is configured to process the processing liquid continuously. Embodiments of the present disclosure may provide a vibrating probe for generating pressure waves within the reactor. The pressure waves generated by the probe provide the ability to induce the formation of nano-sized bubbles in the processing liquid. These bubbles oscillate and eventually collapse leading the creation of hotspots. In addition, the formation of a jet upon bubble collapse allows cluster disruptions and favors mixing.

One of the main challenges of ultrasonically induced cavitation technologies includes the control and optimization of residence time in the reactor. In disclosed embodiments, the residence time is the time a pocket of fluid spends within the reactor during a continuous process. Controlling the residence time allows selectively performing certain reactions. In fact, slow reactions can be avoided by exposing the fluid for less time to the reactive environment. An advantage of the disclosed design an embodiment that is capable of keeping liquid inside (for example, a vessel, such as a reactor) for an amount of time long enough to produce oxidation but not too long so that secondary reactions may be avoided.

For some UIC reactors incorporating probes within their interiors, dead zones may easily form where the processing liquid stagnates. Dead zones may be regarded as zones in which no reactivity is experienced as reactant and reagents are not in contact or the temperature is lower than necessary. Disclosed embodiments preferably control the residence time accurately without the formation of dead zones, and increase the exposure of the processing liquid to the cavitating/reacting zone (i.e., the zone in which cavitation takes place) compared to conventional designs.

Disclosed reactor 100 may consist of a vessel 102 of arbitrary shape and size in which a probe (sonotrode) is inserted and configured to vibrate at high frequency (e.g., >20 kHz) for generating cavitation bubbles. In some embodiments, vessel 102 forms a chamber for receiving the probe (sonotrode). A preferred shape of reactor 100 is cylindrical although other geometric shapes may be considered. Additionally, the vessel may be configured as a tubular chamber for receiving the probe (sonotrode).

A 2D representation of a sonotrode 104 adopted in the verification of the disclosed concept is illustrated in FIG. 1. Sonotrode 104 may comprise variety of shapes generally along a length of its surface. In some embodiments, modules or appendages 118 may be configured onto and/or extend from the body of sonotrode 104. Thus, the diameter of sonotrode 104 may vary generally along its length. Accordingly, sonotrode 104 is enabled to vibrate thereby creating one or more or multiple cavitation zones along the length of sonotrode 104. Thus, the variety of shapes of sonotrode 104 may directly affect the production of one or more cavitation zones. Thus, in one select embodiment, sonotrode 104 may be configured to vibrate at a frequency ranging from approximately 20 to 24 kHz wherein the amplitude ranges from approximately 15-210 microns. In some disclosed embodiments, sonotrode 104 may be configured with a self-synchronizing mechanism which allows sonotrode 104 to control the temperature and pressure of the disclosed system. Furthermore, select embodiments provide using the power output of the sonotrode 104 as a feedback.

Figure 8:
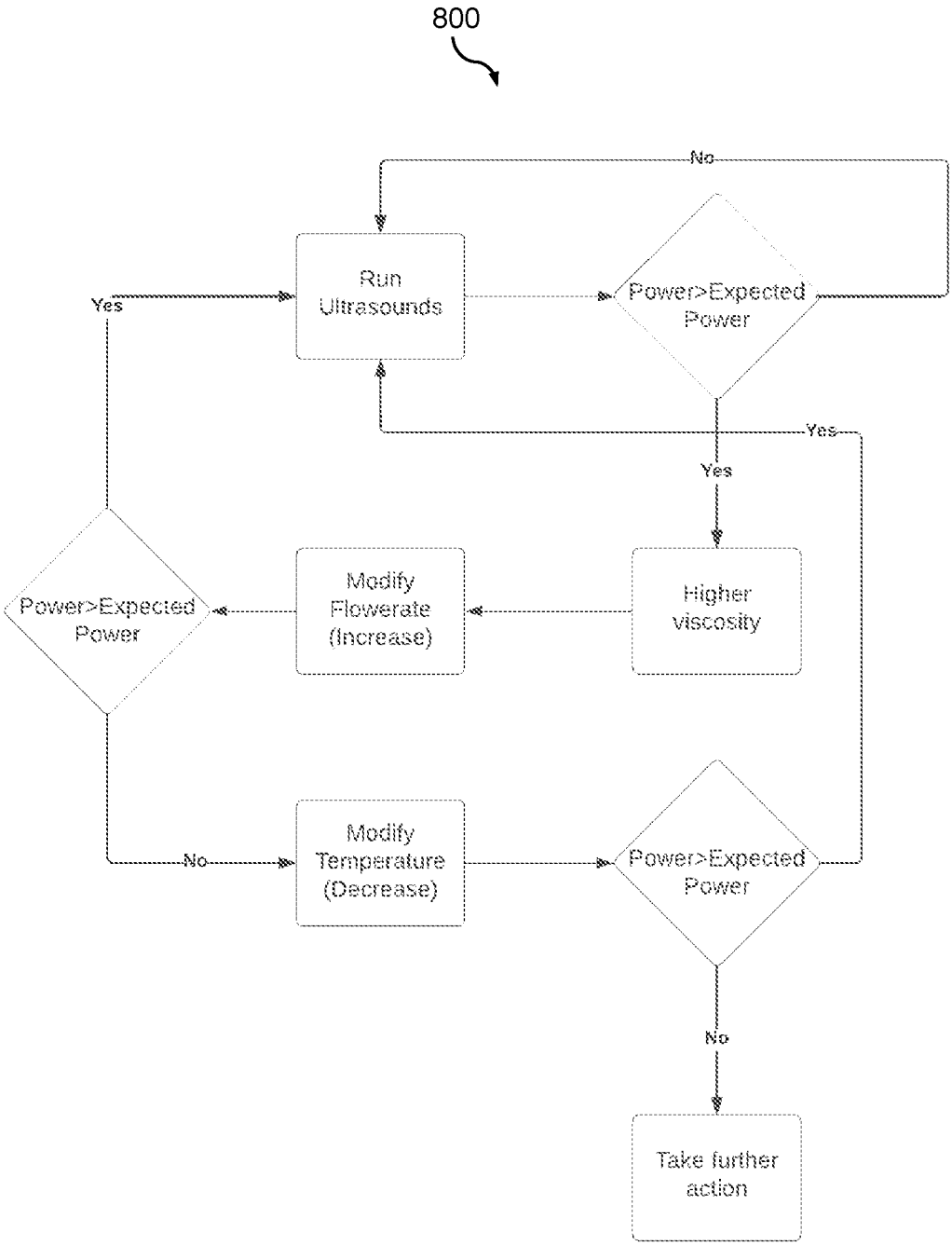
FIG. 8 illustrates a schematic of an exemplary feedback loop for controlling power of a disclosed sonotrode according to one embodiment of the present disclosure.

FIG. 8 illustrates a schematic of an exemplary feedback loop 800 for controlling power of a disclosed sonotrode 104 according to one embodiment of the present disclosure. In one disclosed embodiment, a thermocouple and a pressure transmitter may be utilized and configured to read temperature and pressure, such as within the reaction chamber 102. Based on the reading, the amplitude of the sonotrode changes together with its power input. If temperature is higher than a prescribed set point, the amplitude decreases. If the temperature is lower than a prescribed set point, the amplitude increases. The power of the sonotrode depends on the viscosity of the liquid and on the pressure in the vessel 102. If the viscosity is a parameter that is utilized to discriminate between a desired and undesired product, the disclosed system may be controlled by adjusting flowrate, temperature, etc. as a response to a change in viscosity.

The distance of the reactor walls 106 from the surface of sonotrode 104 may be arbitrary. In some disclosed embodiments, the reactor walls may be set at a distance of approximately 0.5 to 5 times the diameter of the smallest diameter of the sonotrode. This ratio may be determined depending on the flowrate and the feedstock to process. In select embodiments, $D_{sonotrode}$ is defined as the widest point of sonotrode 104 such as at its widest diameter along its longitudinal axis 116. $D_{reactor}$ is defined as the diametric distance between the interior walls of vessel 102 along its longitudinal axis and in which sonotrode 104 may be contained. Thus a ratio $D_{sonotrode}/D_{reactor}$ is established and, in some embodiments, $D_{sonotrode}/D_{reactor}$ is above 0.1 and below 1.

A fluid flow may be configured to flow parallel to sonotrode 104, entering, for example, from a first zone 108 and exiting from another zone such as a second zone 110.

Figure 2:
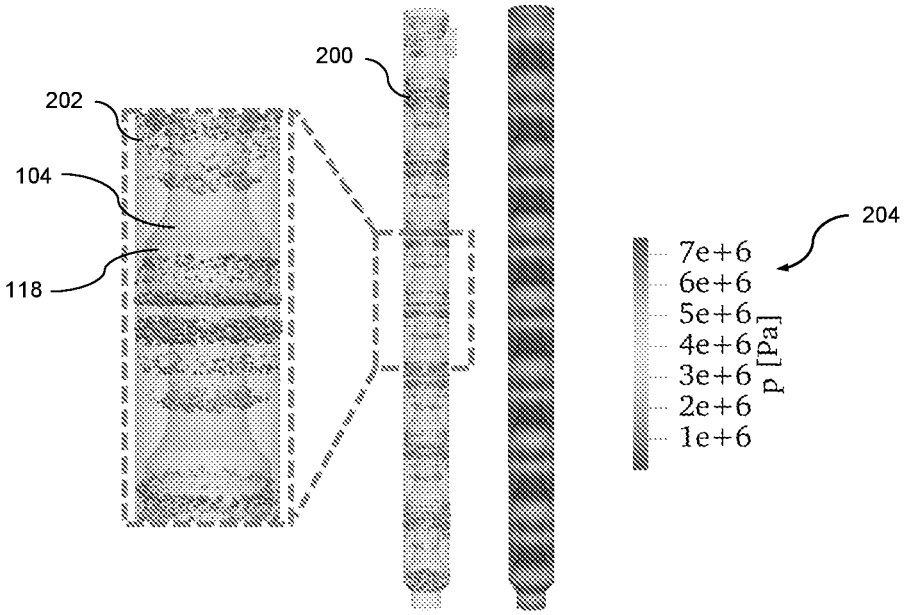
FIG. 2 illustrates exemplary reaction zones during the formation of bubble clouds according to one embodiment of the present disclosure.

FIG. 2 illustrates exemplary reaction zones 200 during the formation of bubble clouds 202 produced by sonotrode 104. Reactor 100 may have an arbitrary number of reaction zones 200 that correspond to modules 118 (or each appendix) of sonotrode 104 as illustrated, for example, in the numerical simulation 204 presented in FIG. 2. Numerical simulation 204 shows the zones of high activity of cavitation. FIG. 2 shows the bubble size distribution achieved in the reactor on the left and the pressure on the right.

Figure 3:
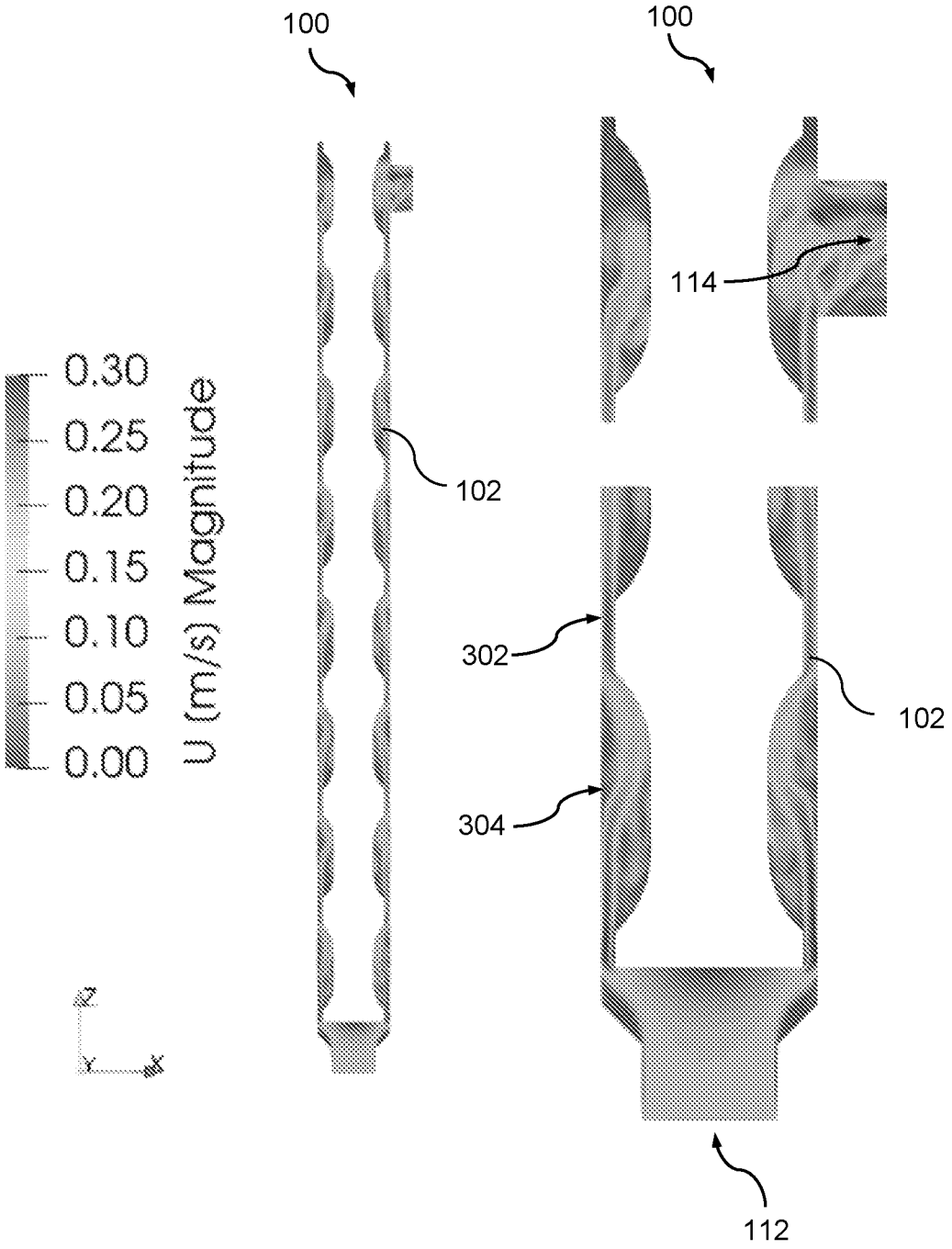
FIG. 3 illustrates an exemplary fluid flow within a disclosed reactor according to one embodiment of the present disclosure.

FIG. 3 illustrates an exemplary fluid flow of the disclosed invention. FIG. 3 illustrates compression zones 302 and expansion zones 304 (also FIG. 1) formed in reactor 100 as a consequence of the narrow zone (i.e., the gap between the module 118 and the vessel walls 106) around sonotrode modules 118. Exemplary pressure values are quantified to the left in FIG. 3. The disclosed expansion zones 304 present generally lower velocity allowing more fluid to pass through and, therefore, more exposition of the fluid parcels to bubbles. Eventually, reagents can be intermittently or continuously injected directly into the expansion zones 304, further favoring control and mixing. Creating the disclosed compression zones 302 and expansion zones 304 facilitates further increasing eventual cavitation. Also, in the zone of maximum activity, the fluid flow is faster while it slows down in the less reactive zone.

Figure 4:
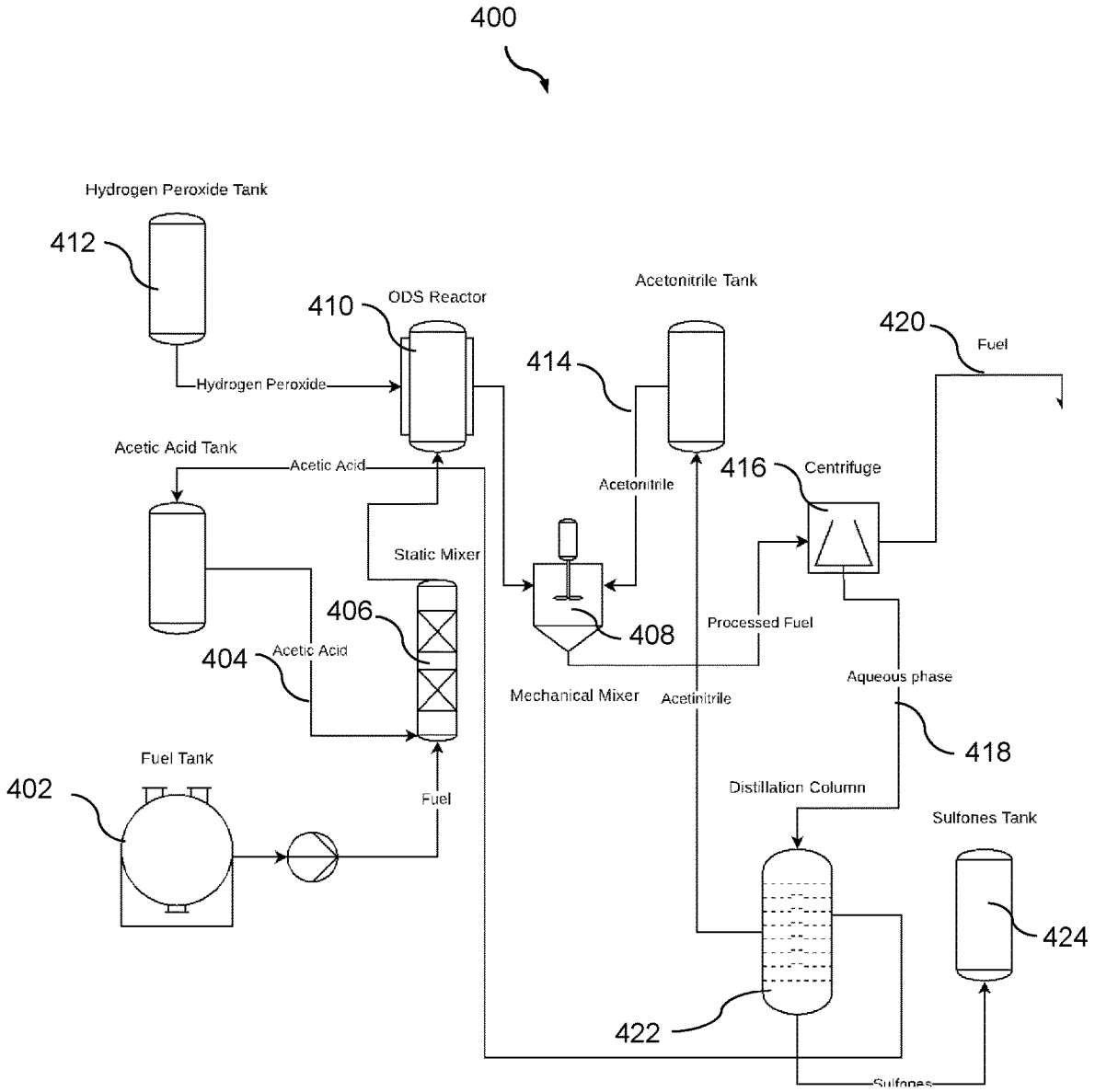
FIG. 4 illustrates a process scheme according to one embodiment of the present disclosure.

FIG. 4 illustrates a system and process scheme 400 of the disclosed invention. The disclosed UIC-aided ODS process may include a system and method for removing sulfur-containing molecules from hydrocarbon mixtures. The disclosed system and process is suitable to desulfurize a wide variety of fuels including HFOs, diesel, vacuum residues, base oils and all other petroleum fractions containing sulfur. In some embodiments, the operating fuel may include Variable-Ratio Oiling (VRO), Shale Oil and any other liquid fuel with high sulfur content (S wt %>0.2) and high boiling point (>480 K). The aforementioned wide variety of fuels may be supplied, for example, from a fuel source such as fuel tank 402.

According to some disclosed embodiments, the fuel may be mixed with an organic acid 404 such as in a static or mechanic mixer 406, 408. (While static or mechanic mixer 406, 408 are illustrated in FIG. 4, it is readily appreciated that mixers 406, 408 may be any other kind of mixing device sufficient for mixing the disclosed mixture(s).) Fuel tank 402 may be heated at a temperature range from approximately 300 K to 380 K (depending on the fuel being treated). The static or mechanic mixer 406, 408 may also be heated to maintain a low viscosity of the fuel.

The fuel may be configured to flow through the ultrasonically induced cavitation (UIC) chamber of the reactor 410. In some disclosed embodiments, reactor 410 may utilize the exemplary ultrasonically induced cavitation (UIC) reactor 100 of FIG. 1. Hydrogen peroxide ($H_2O_2$) may be supplied via a tank 412. Hydrogen peroxide ($H_2O_2$) may be supplied and injected in reactor 410. In some disclosed embodiments, hydrogen peroxide ($H_2O_2$) may configured to be injected (such as radially) at different locations along reactor 410. The concentration of hydrogen peroxide ($H_2O_2$) may be between approximately 20% to 60% in water.

The temperature of the ultrasonically induced cavitation (UIC) chamber of reactor 410 may be controlled and maintained, for example, within a range of approximately 330 to 380 K. The sonotrode 104 (FIG. 1) (e.g., disposed within the UIC chamber (102 of FIG. 1)) may be operated at a frequency between approximately 20 to 24 kHz, while the amplitude of the sonotrode may range approximately 15 to 210 microns. In one embodiment, the residence time in reactor 410 may not exceed 2 minutes per pass, and up to 10 passes may be applied. The characteristics of the residence time may be maintained, for instance, by imposing the flowrate through the reactor.

In accordance with disclosed embodiments, the fluid (e.g., fuel or any other mixture of fluids such as oxidant/fuel, oxidant/catalyst/fuel etc.) is configured to flow generally parallel to sonotrode 104 (FIG. 1). In preferred embodiments, the shape of reactor 100 facilities that the fluid flows parallel to the reactor. Another contributing factor includes the inclination and design of each sonotrode module 118 which influences the fluid flow path direction. A variable flowrate can be applied as long as the residence time is respected. Thus, if the viscosity of the fluid or the temperature in the vessel increases, the power input of the sonotrode changes. If the power input changes, cavitation occurs in larger or smaller regions, therefore the flowrate has to be adapted.

The sonotrode 104 (FIG. 1) may be configured with one or more cavitation zones having a variety of shapes. In some embodiments sonotrode 104 (FIG. 1) is configured with multiple cavitation zones comprising variety of shapes. A 2D representation of the sonotrode adopted in the validation of the disclosed process is illustrated in FIG. 2. The distance of the reactor walls from the sonotrode may be tuned depending on the flowrate and the fuel. Some preferred embodiments, maintain a ratio $D_{sonotrode}/D_{reactor}$ above 0.01 and below 1. Thus, depending on the amount of sulfur to remove, disclosed embodiments may be configured to decrease or increase the flowrate in order to give the mixture fluid (e.g., fuel or any other mixture of fluids such as oxidant/fuel, oxidant/catalyst/fuel etc.) more time to experience oxidation.

In disclosed embodiments, the fraction of hydrogen peroxide is preferably the stoichiometric equivalent of the sulfur (i.e., 1 mole of sulfur is equal to 2 moles of hydrogen peroxide) although any combination in a range of approximately 0.5 to 3 is possible. However, in some embodiments, the molar ratio between hydrogen peroxide ($H_2O_2$) and sulfur molecules varies preferably between 0.5 to 2. Disclosed embodiments provide that hydrogen peroxide injections may take place at specific flowrates. According to some disclosed embodiments, an oxidizer is may be injected directly in the cavitation regions of the reactor (such as radially), although it may also be pre-mixed with the supplied fuel 402. According to disclosed embodiments, the oxidizer serves to oxidize the sulfur selectively increasing the polarity of the molecules that contain sulfur.

In disclosed embodiments, the fraction of acetic acid is variable and can range from approximately 0.5 to 10 times the molar equivalent of hydrogen peroxide. In some preferred embodiments, the molar ratio of acetic acid to oxidizer varies from 0.5 to 3.

The disclosed mixture of fuel, water, hydrogen peroxide and acetic acid may be mixed with extractants to selectively remove sulfones. In some embodiments, disclosed extractants may include acetonitrile 414, methanol or any combination of the two such as in a mixer (e.g., either mechanical/static or of other kind). A mass equivalent of extractant is preferable, although the weight ratio may vary in range between approximately 0.01 to 10. In accordance with one disclosed embodiment, the mixing may occur at a temperature range from approximately 300 K to 350 K.

The disclosed mixture (e.g., desulfurized fuel/water/acetonitrile and/or methanol/acetic acid/sulfones) may be separated, for example, in a centrifuge 416. In one disclosed embodiment, the aqueous phase 418 consists of the extractant (pure acetonitrile in the disclosed example), sulfones, water and eventually acetic acid. The organic phase consists of desulfurized fuel 420. The extractant and the acid catalyst may be recovered and recycled in accordance with the disclosed process. The distillation column 422 serves to recover acetic acid, water and acetonitrile in the form of pure liquids. The residue consists of sulfones that may eventually be stored or repurposed such as at sulfones tank 424.

Figure 5:
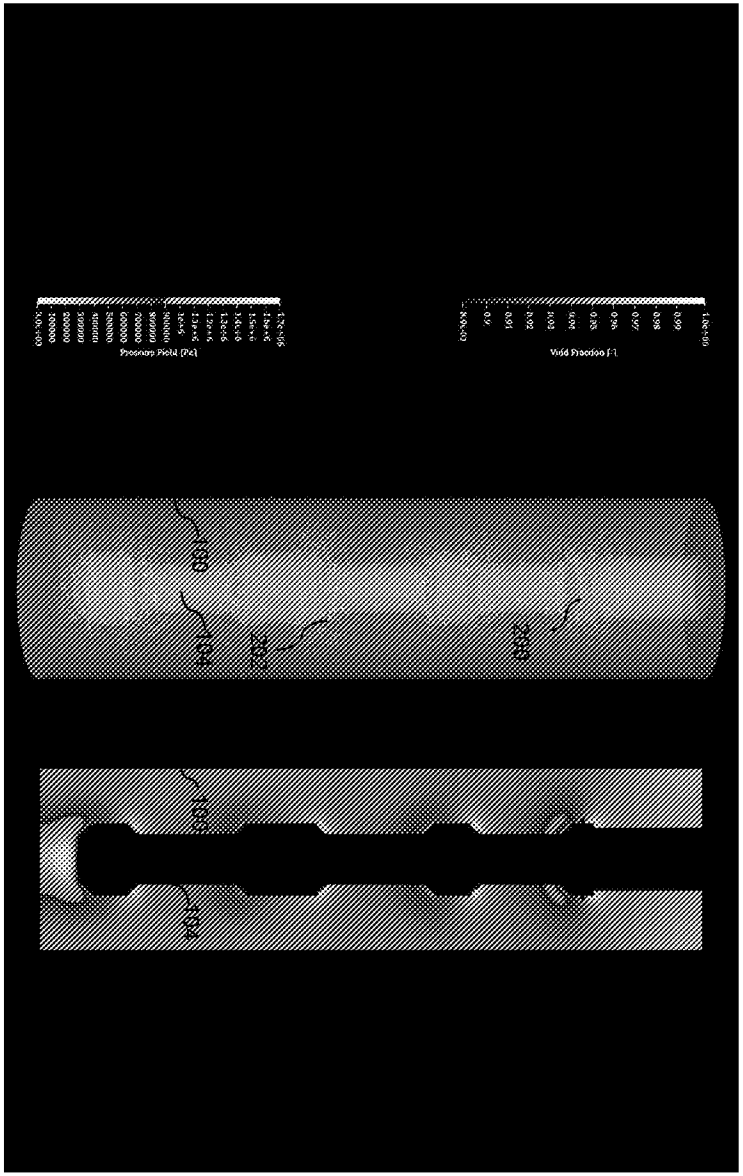
FIG. 5 illustrates the occurrence of cavitation reproduced through computational fluid dynamics (CFD) simulations according to one embodiment of the present disclosure.

The occurrence of cavitation in the disclosed UIC reactor configuration 100 is reproduced through computational fluid dynamics (CFD) simulations and highlighted in FIG. 5. The cavitating zone is the most reactive of the system because of the presence of bubbles (which may include micro bubbles (i.e., bubbles having a micron diameter range)) which oscillate and eventually collapse, releasing radicals and triggering gas-liquid reactions. In some embodiments, the aforementioned oscillation and collapse may result in producing very high temperatures and pressures and generating chemical radical species, which in turn trigger gas-liquid reactions. It is noted that disclosed embodiments may produce areas having locations above and below the cavitation zones of the sonotrode which are larger than the main body of the sonotrode.

Another strong contribution to higher efficiency in desulfurizing disclosed heavy fuel oils is the emulsification of the fuel and the water/acetic acid/hydrogen peroxide mixture which is present in reactor 100. Thus, in accordance with disclosed embodiments, the gas-liquid reactions and the liquid-liquid reactions take place at the emulsified droplets interface. These two phenomena, together with the improved mixing, homogeneous temperature and select choice of reactants, allow successful and improved sulfur oxidation. The disclosed design of reactor 100 plays a key role in achieving this enhanced end-goal/scenario.

Gas-liquid and liquid-liquid reactions take place as a consequence of the formation of bubbles and emulsions respectively. Gas-liquid reactions take place at the interface between a component in the gas phase and a component in the liquid phase while liquid-liquid reactions take place at the interface between two liquids. The reaction rate of those reaction is generally proportional to the surface contact between the two phases. Maximizing the aforementioned surface contact maximizes the reactivity of the disclosed system, hence the formation of the disclosed product. The disclosed system helps maximize aforementioned surface contact while avoiding areas in which secondary reactions take place.

Referencing FIG. 1, the disclosed UIC reactor 100 is composed of a vessel 102 in which the fluid may be configured to flow through an inlet 112 to an outlet 114. In one preferred embodiment, the fluid is configured to flow parallel to sonotrode 104. Sonotrode 104 is arranged in a configuration that allows its vibrations inside the vessel 102 although the contact is sealed. Sonotrode 104 is submerged in reactor 100 and the direction of the vibration is parallel to the fluid flow. The importance of having the fluid flowing parallel to sonotrode 104 is that the fluid does not stagnate in regions at high temperature. The exposure of the fuel to high temperature for long periods of time may lead to the formation of gums and polymers which would make the fuel unusable. Multiple variations on the surface of sontorode 104, such as bumps 118 along the main cylinder of sonotrode 104, correspond to multiple zones in which cavitation occurs. Optionally the reactants (i.e., species involved in the reaction (e.g., acetic acid, hydrogen peroxide and the fuel itself)) may be injected, for example radially, directly on the cavitation zones.

The characteristic time of oxidation in the condition at which the process operates is in within a range of approximately 5-50 seconds. Polymerization and gum formation take place within larger time scales. The disclosed configuration allows a residence time in the reactive zone at approximately 5-10 seconds as calculated from the simulation. In disclosed embodiments, reactive zones may be intended to mean the multiple reacting zones or cavitating zones. The reactive zones are the zones were reactivity is enhanced by nucleation/formation/collapse of bubbles.

Figure 7:
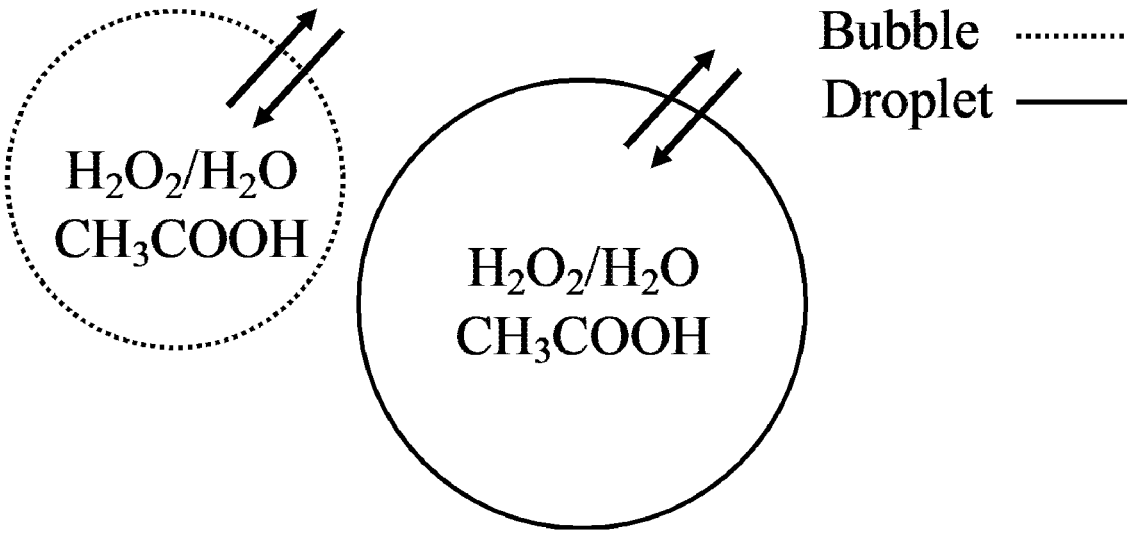
FIG. 7 illustrates a schematic of bubbles and droplets in an exemplary cavitating HFO/peroxide/catalyst mixture according to one embodiment of the present disclosure.

FIG. 7 illustrates a schematic of bubbles and droplets in an exemplary cavitating HFO/peroxide/catalyst mixture according to one embodiment of the present disclosure. Even more, FIG. 7 illustrates the mechanism of multi-phase reactivity believed to cause higher efficiency in the disclosed process. Such disclosed embodiments provide that both catalyst and oxidizing agent are present in the gas phase as bubbles, and in the liquid phase, as dispersed droplets into an emulsion. Hence, FIG. 7 illustrates the mechanism of bubble-droplets interaction with the bulk fluid. This implies a mechanism of liquid-liquid and gas-liquid reactivity which are provided by disclosed embodiments to increase the yield of the process. It is readily appreciated in addition to the disclosed HFO, a more general oil matrix may be utilized instead as well as any other petroleum or petroleum derivate containing sulfur in disclosed embodiments.

Thus, the disclosed embodiment provides a novel optimum reactor configuration to optimize the ODS process. In particular, the multiple cavitation zones, when utilized, for example, with the correct flowrate, allows to selectively oxidize sulfur in a fuel mixture and avoid secondary reaction which may otherwise commonly take place in other conventional batch systems and configurations. In accordance with disclosed embodiments, the correct flowrate is the flowrate that guarantees a residence time that closely matches the characteristic chemical time for the desired reaction. Chemical reaction involves specific time scales. The flowrate required for the disclosed ODS process is the one that guarantees that the pocket of fluid stays in the reactive zones (cavitating zones) for a time close to the chemical timescale of the sulfur oxidation reaction.

Innovative aspects of the disclosed invention provide that the combined use of an organic acid as a catalyst in combination with utilizing ultrasounds is particularly effective in improving the conversion of thiophenes to sulphones. The disclosed reactor configuration allows a combined effect of ultrasonically induced cavitation and hydrodynamic cavitation. In accordance with disclosed embodiments, hydrodynamic cavitation is generated when the fluid crosses the narrow gap between the sonotrode and reactor walls. Disclosed aspects of the invention find that having the cavitation zones in series, together with maintaining a suitable flowrate, reduces the possibility of experiencing polymerization of the mixture as well as gum formation. Accordingly, the disclosed design facilitates ultrasonically induced cavitation which breaks the asphaltene clusters that would otherwise result in reduced viscosity.

Disclosed embodiments preferably utilize a coupled mechanism of liquid-liquid and gas-liquid surface reactions, because of the simultaneous presence of bubbles and emulsion droplets. Some embodiments of the disclosed process may be mostly suitable for heavy fuels, hence with a boiling point above approximately 480 K, because they tend to have more thiophenic aggregates compared to lighter cuts.

The disclosed technology is a key component in the process of oxidative desulfurization. Disclosed embodiments may be used in a multi-step process which is aimed to desulfurize heavy fuels, for example, within the marine industry, vacuum residues or biomass for gasifiers and eventually as a pre-treatment for fuels operated in boilers.

Having described the many embodiments of the present disclosure in detail, it will be apparent that modifications and variations are possible without departing from the scope of the invention defined in the appended claims. Furthermore, it should be appreciated that all examples in the present disclosure, while illustrating many embodiments of the invention, are provided as non-limiting examples and are, therefore, not to be taken as limiting the various aspects so illustrated.

Figure 6:
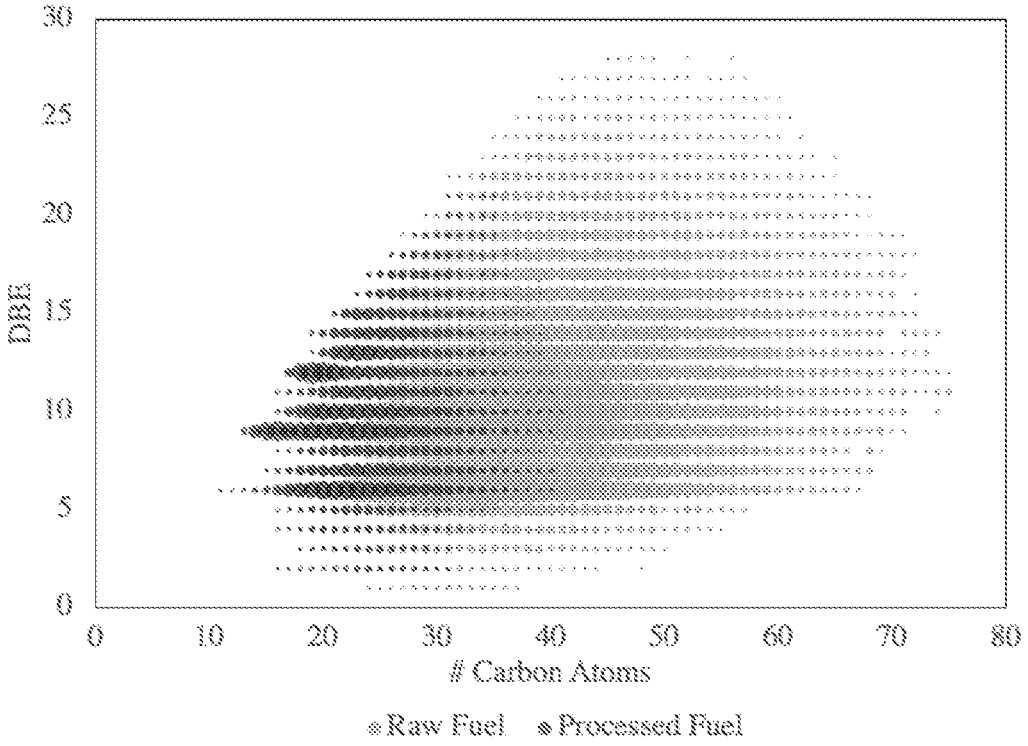
FIG. 6 illustrates the distribution of sulfur molecules in Arabian Extra Light (AXL) before and after sonication according to one embodiment of the present disclosure.

The disclosed process is tested on Arabian Extra Light (AXL) and Heavy Fuel Oil (HFO) 380 mixtures 90/10. The results obtained on AXL are reported in FIG. 6 in terms of reduction of sulfur molecules. FIG. 6 illustrates the distribution of sulfur molecules in AXL before and after sonication. The range of sulfurized molecules substantially reduces after the ODS. The test is performed in the KAUST ODS rig on AXL. Results shown are from FTICR-MS performed on the samples. The size of the points reflects the relative amount of the species. DBE stands for double bond equivalent, a measure of aromaticity.

Described embodiments support those heavy fuels are more prone to be desulfurized by the disclosed ODS process compared to lighter distillates. This is caused by the higher propensity of thiophenes to be oxidized. The amount of sulfur of HFO is mostly thiophenic while sulfur resides in light distillates in the form of sulfide.

In one embodiment, the process is run in a pilot plant operating at 60 Kg/hour. The temperature of the pipes is maintained at approximately 330 K. The reactor temperature may be oscillated between approximately 335 and 340 K. The sonotrode may be operated with variable amplitude (adjusted on pressure) and at a frequency of approximately 20 KHz. In some disclosed embodiments, working amplitude ranges from 15 to 210 microns.

The amount of $H_2O_2$ is approximately three times the stoichiometric equivalent. The oxidizer is diluted in water approximately at a 30% by mass.

A stoichiometric equivalent of acetic acid may be added to the process. The disclosed separation may be performed by using an equivalent mass of acetonitrile in total.

The conversion results obtained on HFO 380 are reported in Table 1 [0088] Table 1 in term of sulfur mass percentage reduction.

TABLE 1

Results of the experimental campaign on AXL/HFO 380 mixtures expressed in term of sulfur mass fraction.

| | Test 1 | Test 2 | Test 3 | Test 4 | Test 5 | Test 6 |
|---|---|---|---|---|---|---|
| Fuel (mass percentage in the reactor) | | | | | | |
| HFO wt % [—] | 72.06 | 80.07 | 80.07 | 80.94 | 80.94 | 80.94 |
| AXL wt % [—] | 8.01 | 8.90 | 8.90 | 8.99 | 8.99 | 8.99 |
| Oxidizing Agent (mass percentage in the reactor) | | | | | | |
| $H_2O_2$ wt %[—] (35% by wt/water) | 15.61 | 8.63 | 8.63 | 7.01 | 7.01 | 7.01 |

TABLE 1-continued

| Results of the experimental campaign on AXL/HFO 380 mixtures expressed in term of sulfur mass fraction. | | | | | | |
|---|---|---|---|---|---|---|
| | Test 1 | Test 2 | Test 3 | Test 4 | Test 5 | Test 6 |
| Catalyst (mass percentage in the reactor) | | | | | | |
| $CH_3COOH$ wt % [—] | 4.32 | 2.40 | 2.40 | 3.06 | 3.06 | 3.06 |
| Extraction Agent (added weight percentage) | | | | | | |
| Acetonitrile wt % [—] | 72.06 | 80.07 | 80.07 | 80.94 | 0.00 | 80.94 |
| Methanol wt % [—] | 0.00 | 0.00 | 0.00 | 0.00 | 80.94 | 0.00 |
| Separation Method | | | | | | |
| Separation Method | MECH/CENT | MECH/CENT | MECH/CENT | MECH/CENT | MECH/CENT | UIC/CENT |
| Separation Steps # | 5.00 | 7.00 | 7.00 | 3.00 | 1.00 | 1.00 |
| Separation Temperature | 25.00 | 25.00 | 25.00 | 40.00 | 45.00 | 25-40 |
| Reactor Parameters | | | | | | |
| Flowrate [tpd] | 2.63 | 2.34 | 2.33 | 2.12 | 2.12 | 2.32 |
| Power [kW] | 1.4 | 1.4 | 1 | 1 | 1.4 | 1.4 |
| Equivalence Ratio of Oxidizer | 2 | 1 | 1 | 0.8 | 0.8 | 0.8 |
| Results (conversion in terms of sulfur percentage reduction) | | | | | | |
| Conversion wt % [—] | 88 | 88.32 | 84.1 | 84.32 | 74.8 | 86.6 |
| Fuel Recovery wt % [—] | 83 | 84 | 84 | 82 | 79 | 88 |
| Within IMO | Yes | Yes | Yes | Yes | No | Yes |

All documents, patents, journal articles and other materials cited in the present application are incorporated herein by reference.

While the present disclosure has been disclosed with references to certain embodiments, numerous modification, alterations, and changes to the described embodiments are possible without departing from the sphere and scope of the present disclosure, as defined in the appended claims. Accordingly, it is intended that the present disclosure not be limited to the described embodiments, but that it has the full scope defined by the language of the following claims, and equivalents thereof.

What is claimed is:

1. A process for removing sulfides from liquid fossil fuel comprising:

mixing the liquid fossil fuel with an oxidizer and catalyst to form a multiphase reaction medium and producing a fluid flow of the multiphase reaction medium;

applying ultrasound to the multiphase reaction medium in an ultrasound reactor to cause oxidation of sulfides in the liquid fossil fuel to sulfones; and extracting the sulfones to yield an organic phase and aqueous phase, wherein the ultrasound is performed by generating vibrations parallel to the fluid flow of the multiphase reaction medium, wherein the organic phase substantially consists of desulfurized fuel;

wherein the ultrasound reactor comprises:

a vessel configured to receive the liquid fossil fuel, oxidizer and catalyst as the multiphase reaction medium; and a vibrating probe disposed within walls of the vessel, wherein the multiphase reaction medium is configured to flow generally parallel to the probe, wherein the vibrating probe is configured to produce pressure waves to induce formation of nano-sized bubbles in the multiphase reaction medium along one or more cavitation zones along a length of the vibrating probe, wherein the vessel walls are at a distance of approximately 0.5 to 5 times the diameter of a smallest diameter of the vibrating probe;

wherein the vibrating probe comprises a sonotrode, and wherein the process further comprises controlling a temperature and a pressure of the vibrating reactor using a power output of the sonotrode as feedback.

2. The process of claim 1 comprising:

separating oxidized molecules using liquid-liquid extraction to produce oxidation of sulfur components in the liquid fossil fuel.

3. The process of claim 1, wherein the liquid fossil fuel is selected from a group of fuel comprising: Variable-Ratio Oiling (VRO), Heavy Fuel Oil (HFO), Shale Oil and any other liquid fuel with a high sulfur content S superior to 0.2 wt % and a high boiling point superior to 480 K.

4. The process of claim 1, comprising:

varying a diameter of the sonotrode along its length.

5. The process of claim 1, comprising:

producing the one or more cavitation zones based upon a geometrical configuration along a length of the sonotrode.

6. The process of claim 1, wherein a viscosity of the multiphase reaction medium or the temperature in the vibrating reactor affects the power output of the sonotrode.

7. The process of claim 6, comprising:

adjusting the power output based on a flowrate of the multiphase reaction medium.

8. The process of claim 1, comprising:

adjusting a flowrate of the multiphase reaction medium based on achieving a prescribed residence time in the ultrasound reactor.

9. The process of claim 8, wherein the ultrasound reactor is configured to pass the multiphase reaction medium multiple times through the vessel, the prescribed residence time in the ultrasound reactor does not exceed 2 minutes per pass.

10. The process of claim 9, wherein the multiphase reaction medium passes up to 10 times in the ultrasound reactor.

11. The process of claim 1, comprising:

vibrating the vibrating probe at a frequency ranging from approximately 20 to 24 kHz, and an amplitude of 15 to 210 microns.

12. The process of claim 1, comprising:

producing the nano-sized bubbles as micro bubbles having a micron diameter range.

13. The process of claim 1, comprising:

continually processing the multiphase reaction medium.

14. The process of claim 1, comprising:

radially injecting the oxidizer and/or catalyst into the vibrating reactor intermittently or continuously.

15. A process for removing sulfides from liquid fossil fuel comprising:

mixing the liquid fossil fuel with an oxidizer and catalyst to form a multiphase reaction medium and producing a fluid flow of the multiphase reaction medium;

applying ultrasound to the multiphase reaction medium in an ultrasound reactor to cause oxidation of sulfides in the liquid fossil fuel to sulfones; and extracting the sulfones to yield an organic phase and aqueous phase, wherein the ultrasound is performed by generating vibrations parallel to the fluid flow of the multiphase reaction medium, wherein the organic phase substantially consists of desulfurized fuel;

wherein the ultrasound reactor comprises:

a vessel configured to receive the liquid fossil fuel, oxidizer and catalyst as the multiphase reaction medium; and a vibrating probe disposed within walls of the vessel, wherein the multiphase reaction medium is configured to flow generally parallel to the probe, wherein the vibrating probe is configured to produce pressure waves to induce formation of nano-sized bubbles in the multiphase reaction medium along one or more cavitation zones along a length of the vibrating probe, wherein the vessel walls are at a distance of approximately 0.5 to 5 times the diameter of a smallest diameter of the vibrating probe;

wherein the vibrating probe comprises a sonotrode, and wherein applying ultrasound is performed using the vibrating probe at a frequency ranging from approximately 20 to 24 kHz, and an amplitude of 15 to 210 microns.

16. The process of claim 15, comprising:

separating oxidized molecules using liquid-liquid extraction to produce oxidation of sulfur components in the liquid fossil fuel.

17. The process of claim 15, wherein the liquid fossil fuel is selected from a group of fuel comprising: Variable-Ratio Oiling (VRO), Heavy Fuel Oil (HFO), Shale Oil and any other liquid fuel with a high sulfur content S superior to 0.2 wt % and a high boiling point superior to 480 K.

18. The process of claim 15, further comprising controlling a temperature and a pressure of the vibrating reactor using a power output of the sonotrode as feedback.

19. The process of claim 18, wherein a viscosity of the multiphase reaction medium or the temperature in the vibrating reactor affects the power output of the sonotrode, the process further comprising:

adjusting the power output based on a flowrate of the multiphase reaction medium.

20. The process of claim 15, further comprising:

adjusting a flowrate of the multiphase reaction medium based on achieving a prescribed residence time;

wherein the prescribed residence time in the vibrating reactor does not exceed 2 minutes per pass.

* * * * *